US008071518B2

(12) United States Patent
Yagishita et al.

(10) Patent No.: US 8,071,518 B2
(45) **Date of Patent: *Dec. 6, 2011**

(54) LOW ASH ENGINE OIL COMPOSITION

(75) Inventors: Kazuhiro Yagishita, Yokohama (JP); Akira Yaguchi, Yokohama (JP); Kenichi Komiya, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 348 days.

This patent is subject to a terminal disclaimer.

(21) Appl. No.: 12/282,730

(22) PCT Filed: Feb. 22, 2007

(86) PCT No.: PCT/JP2007/053855

§ 371 (c)(1),
(2), (4) Date: Sep. 12, 2008

(87) PCT Pub. No.: WO2007/119299

PCT Pub. Date: Oct. 25, 2007

(65) Prior Publication Data

US 2009/0075852 A1 Mar. 19, 2009

(30) Foreign Application Priority Data

Mar. 22, 2006 (JP) ..... 2006-079729

(51) Int. Cl.
*C10M 145/14* (2006.01)
*C10M 169/04* (2006.01)
*C10M 159/24* (2006.01)

(52) U.S. Cl. ..... 508/469; 508/287; 508/391

(58) Field of Classification Search ..... 508/287, 508/469, 391

See application file for complete search history.

(56) References Cited

U.S. PATENT DOCUMENTS

| | | | | |
|---|---|---|---|---|
| 4,263,152 | A | 4/1981 | King et al. | |
| 5,744,430 | A | 4/1998 | Inoue et al. | |
| 2002/0142922 | A1 | 10/2002 | Yagishita et al. | |
| 2004/0242434 | A1 | 12/2004 | Yagishita et al. | |
| 2005/0107269 | A1 | 5/2005 | Yagishita | |
| 2005/0130854 | A1 | 6/2005 | Yagishita | |
| 2005/0130855 | A1 | 6/2005 | Yagishita | |
| 2005/0245402 | A1* | 11/2005 | Yagishita | 508/185 |
| 2006/0063686 | A1* | 3/2006 | Yagishita | 508/518 |
| 2006/0276351 | A1* | 12/2006 | Mucha et al. | 508/199 |

FOREIGN PATENT DOCUMENTS

| | | | |
|---|---|---|---|
| EP | 1 437 396 | A1 | 7/2004 |
| EP | 1 439 217 | A1 | 7/2004 |
| EP | 1 516 910 | A1 | 3/2005 |
| EP | 1 526 169 | A1 | 4/2005 |
| EP | 1526170 | A1 | 4/2005 |
| EP | 1 686 167 | A1 | 8/2006 |
| GB | 2 053 267 | A | 2/1981 |
| JP | 56-10591 | | 2/1981 |
| JP | 2002-294271 | A | 10/2002 |
| JP | 2004-35619 | A | 2/2004 |
| JP | 2004-35620 | A | 2/2004 |
| JP | 2004-83891 | A | 3/2004 |
| JP | 3662228 | B2 | 4/2004 |
| JP | 3615267 | B2 | 11/2004 |
| JP | 2005-146011 | A | 6/2005 |
| JP | 3709379 | B2 | 8/2005 |
| JP | 3738228 | B2 | 11/2005 |
| WO | 98/26030 | A1 | 6/1998 |
| WO | 99/31113 | A1 | 6/1999 |
| WO | 2004/003117 | A1 | 1/2004 |
| WO | 2004003117 | A1 | 1/2004 |
| WO | 2004/013264 | A1 | 2/2004 |
| WO | 2004/013265 | A1 | 2/2004 |
| WO | 2005/037967 | A1 | 4/2005 |

OTHER PUBLICATIONS

Extended European Search Report, dated Mar. 31, 2010 for EP Application No. 0771508.3, 3 pages.

* cited by examiner

*Primary Examiner* — Glenn Caldarola
*Assistant Examiner* — Vishal Vasisth
(74) *Attorney, Agent, or Firm* — Panitch Schwarze Belisario & Nadel LLP

(57) ABSTRACT

The present invention provides a low ash engine oil composition which, despite the low ash content, has engine detergency which enables the composition to pass severe detergency tests for diesel engine oils. The engine oil composition contains 0.6 percent by mass or less of a sulfated ash and comprises a low ash engine oil composition with a sulfated ash content of 0.6 percent by mass or less, which comprises: a lubricating base oil with a % $C_A$ of 2 or less, a kinematic viscosity at 40° C. of 25 $mm^2/s$ or less and a viscosity index of 120 or greater; a viscosity index improver contained in such an amount that the viscosity index of the composition will be 160 or greater; (A) a metallic detergent with a metal ratio of 3 or less; and/or (B) a sulfur-free phosphorus compound.

3 Claims, No Drawings

LOW ASH ENGINE OIL COMPOSITION

CROSS-REFERENCE TO RELATED APPLICATION

This application is a Section 371 of International Application No. PCT/JP2007/053855, filed Feb. 22, 2007, which was published in the Japanese language on Oct. 25, 2007, under International Publication No. WO 2007/119299 A1, and the disclosure of which is incorporated herein by reference.

FIELD OF THE INVENTION

The present invention relates to low ash engine oil compositions. More specifically, the present invention relates to such low ash engine oil compositions that, despite the low ash content, has engine-detergency enabling the compositions to pass severe detergency tests for diesel engine oil and are excellent in fuel efficiency.

BACKGROUND OF THE INVENTION

Conventionally, lubricating oils have been used in internal combustion engines, transmissions and other mechanical devices so as to facilitate the smooth operation thereof. In particular, lubricating oils for internal combustion engines (engine oils) have been required to possess high characteristic performances due to the fact that internal combustion engines have been improved in performances, increased in power output and used under more severe operating conditions. Therefore, conventional engine oils are blended with various additives such as anti-wear agents, metallic detergents, ashless dispersants, and anti-oxidants for fulfilling these performance requirements.

Further, engine oils have been demanded to be improved in fuel efficiency from the view point of recent environmental issues concerning reduction of carbon dioxide emissions. In order to meet the demands, there have been promoted some means such as blending of friction reducing agents such as MoDTC (see Patent Document No. 1 below) or increasing the viscosity index of lubricating oils. Friction reducing agents such as MoDTC are significantly inhibited from performing the initial friction reducing effect when used in diesel engine oils which are likely to be contaminated with soot, and it is thus important to increase the viscosity index of the lubricating oil. In general, a viscosity index improver is blended with a lubricating oil so as to increase the viscosity index thereof. An olefin copolymer is less in viscosity index improving effect while a polymethacrylate viscosity index improver is high in viscosity index improving effect but poorer in thermal stability than the olefin copolymer. Therefore, it is common to blend an olefin copolymer that gives less influence on engine detergency or to reduce the amount of the viscosity index improver to be blended, in an engine oil used in diesel engines which are high in heat load and severe in engine detergency requirements due to contamination by soot. When polymethacrylate is used, it is necessary to blend large amounts of metallic detergents, ashless dispersants and anti-oxidants to maintain engine detergency. As the result, the production cost will be extremely increased and other requisite performances would be adversely affected.

That is, for diesel engine oils, it is very difficult to maintain the engine detergency at a higher level and also improve the fuel saving performance by increasing the viscosity index of the oils.

Recent diesel engines have been equipped with devices for reducing the emission of particulate matters such as diesel particulate filters (DPF). However, the diesel engine oils have been required to be less in ash content to avoid the devices from clogging. Lowering the ash content of an engine oil means decreasing the amount of the metallic detergent, and as the result, there has arisen an important issue concerning securement of the detergency for diesel engines, in particular detergency for the grooves of the top rings, which was maintained by blending large amounts of a metallic detergent and an ashless dispersant.

That is, it is assumed that a low ash diesel engine oil that can accomplish engine detergency and fuel saving performance at higher levels has not existed yet.

As the results of the extensive research and study carried out by the inventors of the present invention to improve the long-drain properties such as base number retention properties, high temperature detergency and fuel efficiency of a lubricating oil, they succeeded in improving these properties by blending phosphorus compounds such as metal salts of alkyl phosphoric acid, using no or less amount of zinc dithiophosphate (ZDTP) that has been conventionally used (see Patent Document No. 2 below), the performances specialized in base number retention properties and high temperature detergency by optimizing metallic detergents (see Patent Document Nos. 3 to 5 below) and the performances specialized in fuel efficiency by lowering the ash or phosphorus content (see Patent Document Nos. 6 to 8 below). However, there is still room for improvement in both engine detergency, in particular top ring groove detergency and fuel saving performance by increasing the viscosity index, for diesel engine oil which is likely to be contaminated with soot.

Patent Document No. 1: Japanese Patent No. 3615267
Patent Document No. 2: Japanese Patent Laid-Open Publication No. 2002-294271
Patent Document No. 3: Japanese Patent No. 3662228
Patent Document No. 4: Japanese Patent No. 3709379
Patent Document No. 5: Japanese Patent No. 3738228
Patent Document No. 6: Japanese Patent Laid-Open Publication No. 2004-035619
Patent Document No. 7: Japanese Patent Laid-Open Publication No. 2004-035620
Patent Document No. 8: Japanese Patent Laid-Open Publication No. 2004-083891

DISCLOSURE OF THE INVENTION

In view of the above-described circumstances, the present invention has an object to provide a low ash engine oil composition that has, despite low ash content, engine detergency enabling the composition to pass severe detergency tests for diesel engine oil and is excellent in fuel efficiency.

As the results of extensive studies carried out by the inventors of the present invention, they have accomplished the present invention on the basis of the finding that detergency for an actual diesel engine, in particular for the top ring grooves at which heat load is high was able to be significantly improved even with an engine oil with a high viscosity index and a low ash content.

That is, according to the present invention, there is provided a low ash engine oil composition with a sulfated ash content of 0.6 percent by mass or less, which comprises: a lubricating base oil with a % $C_A$ of 2 or less, a kinematic viscosity at 40° C. of 25 $mm^2/s$ or less and a viscosity index of 120 or greater; a viscosity index improver contained in such an amount that the viscosity index of the composition will be 160 or greater; (A) a metallic detergent with a metal ratio of 3 or less; and/or (B) a sulfur-free phosphorus compound.

Preferably, the low ash engine oil composition further comprises a metallic detergent with a metal ratio of greater than 3.

Preferably, the viscosity index improver is a polymethacrylate with a PSSI of 10 or greater, and the composition has a viscosity index of 190 or greater.

The low ash engine oil composition comprises at least one type selected from the group consisting of ashless anti-oxidants, organic molybdenum compounds and ashless friction modifiers.

BEST MODE FOR CARRYING OUT THE INVENTION

The present invention will be described in more detail below.

Examples of base oils which may be used for the low ash engine oil composition of the present invention (hereinafter may be referred to as "the composition of the present invention") include mineral base oils and/or synthetic base oils which have been used in conventional lubricating oils.

Examples of the mineral base oils include those which can be produced by subjecting a lubricating oil fraction produced by vacuum-distilling a topped crude resulting from atmospheric distillation of a crude oil, to any one or more treatments selected from solvent deasphalting, solvent extraction, hydrocracking, solvent dewaxing, and hydrorefining; and wax-cracked/isomerized mineral oils produced by hydrocracking and/or isomerizing a raw material containing wax the main component of which is n-paraffin such as slack wax and GTL WAX (Gas to Liquid Wax) produced through a Fischer-Tropsch process. In the present invention, preferred are hydrocracked mineral oils and wax-cracked/isomerized mineral oils because they are excellent in engine detergency and can improve fuel efficiency more.

Examples of synthetic base oils include poly-α-olefins such as 1-octene oligomer, 1-decene oligomer and ethylene-propylene oligomer, and hydrogenated compounds thereof; isobutene oligomers and hydrogenated compounds thereof; isoparaffins; alkylbenzenes; alkylnaphthalenes; diesters such as ditridecyl glutarate, dioctyl adipate, diisodecyl adipate, ditridecyl adipate and dioctyl cebacate; polyol esters (trimethylolpropane esters such as trimethylolpropane caprylate, trimethylolpropane pelargonate and trimethylolpropane isostearynate and pentaerythritol esters such as pentaerythritol 2-ethylhexanoate and pentaerythritol pelargonate); polyoxyalkylene glycols; dialkyldiphenyl ethers; and polyphenyl ethers.

Examples of the lubricating base oil which may be used in the present invention include the above-described mineral base oils and synthetic base oils and mixtures of two or more oils selected from these base oils. For example, the base oil used in the present invention may be one or more of the mineral base oils or synthetic base oils or a mixed oil of one or more of the mineral base oils and one or more of the synthetic base oils.

The % $C_A$ of the lubricating base oil is necessarily 2 or less, preferably 1.5 or less, more preferably 1 or less. A lubricating base oil with a % $C_A$ of greater than 2 would be poor in oxidation stability and fail to retain detergency for a long period of time.

The kinematic viscosity at 40° C. of the lubricating base oil is necessarily 25 $mm^2/s$ or less, preferably 22 $mm^2/s$ or less, more preferably 21 $mm^2/s$ or less, particularly preferably 20 $mm^2/s$ or less. The use of a lubricating base oil with a kinematic viscosity at 40° C. of 25 $mm^2/s$ or less renders it possible to produce an engine oil composition with a higher viscosity index and an excellent fuel efficiency. In view of wear inhibition and evaporation loss inhibition, the kinematic viscosity at 40° C. is preferably 10 $mm^2/s$ or greater, more preferably 14 $mm^2/s$ or greater, particularly preferably 16 $mm^2/s$ or greater.

The viscosity index of the lubricating base oil is necessarily 120 or greater, preferably 130 or greater. The use of a lubricating base oil with a higher viscosity index renders it possible to produce a composition with more excellent oxidation stability, fuel efficiency and low-temperature viscosity characteristics. The viscosity index is usually 250 or less, preferably 200 or less. In the case of a mineral lubricating base oil, the viscosity index thereof is preferably 160 or less because such a base oil is excellent in availability, production cost and low-temperature viscosity characteristics.

Examples of the viscosity index improver which may be used in the present invention include non-dispersant type and dispersant type viscosity index improvers. Specific examples include non-dispersant and dispersant types polymethacrylates, dispersant type ethylene-α-olefin copolymers and hydrogenated compounds thereof, polyisobutylene and hydrogenated compounds thereof, styrene-diene hydrogenated copolymers, styrene-maleic anhydride ester copolymers, and polyalkylstyrenes. Among these viscosity index improvers, it is preferable to use non-dispersant type and/or dispersant type viscosity index improvers, most preferably dispersant type viscosity index improvers having a weight average molecular weight of preferably 80,000 or greater, more preferably 200,000 or greater, more preferably 300,000 or greater, particularly preferably 360,000 or greater and preferably 1,000,000 or less, more preferably 800,000 or less, particularly preferably 600,000 or less.

Specific examples of the non-dispersant type viscosity index improver include homopolymers of monomers selected from the group consisting of compounds represented by formulas (1), (2) and (3) below (hereinafter referred to as "monomer (M-1)"), copolymers of two or more of monomers (M-1), and hydrogenated compounds thereof.

Specific examples of the dispersant type viscosity index improver include copolymers of two or more of monomers selected from the group consisting of compounds represented by formulas (4) and (5) below (hereinafter referred to as "monomer (M-2)") and hydrogenated compounds thereof; and copolymers of one or more of monomers (M-1) selected from the group consisting of compounds represented by formulas (1), (2) and (3) above with one or more of monomers (M-2) selected from the group consisting of compounds represented by formulas (4) and (5) below and hydrogenated compounds thereof.

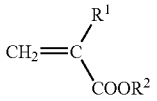

(1)

In formula (1), $R^1$ is hydrogen or methyl, and $R^2$ is hydrogen or an alkyl group having 1 to 18 carbon atoms.

Specific examples of the alkyl group having 1 to 18 carbon atoms for $R^2$ include those, which may be straight-chain or branched, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl groups.

(2)

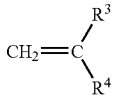

In formula (2), $R^3$ is hydrogen or methyl, and $R^4$ is hydrogen or a hydrocarbon group having 1 to 12 carbon atoms.

Specific examples of hydrocarbon groups having 1 to 12 carbon atoms for $R^4$ include alkyl groups, which may be straight-chain or branched, such as methyl, ethyl, propyl, butyl, pentyl, hexyl, heptyl, octyl, nonyl, decyl, undecyl and dodecyl groups; cycloalkyl groups having 5 to 7 carbon atoms, such as cyclopentyl, cyclohexyl and cycloheptyl groups; alkylcycloalkyl groups, of which the alkyl groups may bond to any position of the cycloalkyl group, having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups; alkenyl groups, which may be straight-chain or branched and the position of which the double bond may vary, such as butenyl, pentenyl, hexenyl, heptenyl, octenyl, nonenyl, decenyl, undecenyl and dodecenyl groups; aryl groups such as phenyl and naphtyl groups; alkylaryl groups, of which the alkyl groups may be straight-chain or branched and bond to any position of the aryl group, having 7 to 12 carbon groups, such as tolyl, xylyl, ethylphenyl, propylphenyl, butylphenyl, pentylphenyl and hexylphenyl groups; and arylalkyl groups, of which the alkyl groups may be straight-chain or branched, having 7 to 12 carbon atoms, such as benzyl, phenylethyl, phenylpropyl, phenylbutyl, phenylpentyl and phenylhexyl groups.

(3)

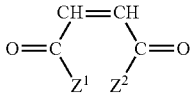

In formula (3), $Z^1$ and $Z^2$ are each independently hydrogen, an alkoxy group having 1 to 18 carbon atoms represented by formula —$OR^5$ wherein $R^5$ is an alkyl group having 1 to 18 carbon atoms, or a monoalkylamino group having 1 to 18 carbon atoms represented by formula —$NHR^6$ wherein $R^6$ is an alkyl group having 1 to 18 carbon atoms.

(4)

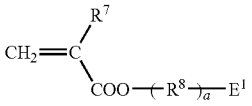

In formula (4) above, $R^7$ is hydrogen or methyl, $R^8$ is an alkylene group having 1 to 18 carbon atoms, $E^1$ is an amine residue or heterocyclic residue having 1 or 2 nitrogens and 0 to 2 oxygens, and a is an integer of 0 or 1.

Specific examples of alkylene groups having 1 to 18 carbon atoms for $R^8$ include ethylene, propylene, butylene, pentylene, hexylene, heptylene, octylene, nonylene, decylene, undecylene, dodecylene, tridecylene, tetradecylene, pentadecylene, hexadecylene, heptadecylene and octadecylene groups, all of which may be straight-chain or branched.

Specific examples of groups represented by $E^1$ include dimethylamino, diethylamino, dipropylamino, dibutylamino, anilino, toluidino, xylidino, acetylamino, benzoilamino, morpholino, pyrrolyl, pyrrolino, pyridyl, methylpyridyl, pyrrolidinyl, piperidinyl, quinonyl, pyrrolidonyl, pyrrolidono, imidazolino and pyrazino groups.

(5)

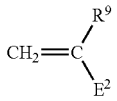

In formula (5), $R^9$ is hydrogen or methyl, and $E^2$ is an amine residue or heterocyclic residue having 1 or 2 nitrogens and 0 to 2 oxygens.

Specific examples of groups represented by $E^2$ include dimethylamino, diethylamino, dipropylamino, dibutylamino, anilino, toluidino, xylidino, acetylamino, benzoilamino, morpholino, pyrrolyl, pyrrolino, pyridyl, methylpyridyl, pyrrolidinyl, piperidinyl, quinonyl, pyrrolidonyl, pyrrolidono, imidazolino and pyrazino groups.

Preferred examples of monomers (M-1) include alkylacrylates having 1 to 18 carbon atoms; alkylmethacrylates having 1 to 18 carbon atoms; olefins styrene, methylstyrene, maleic anhydride ester and maleic anhydride amide, each having 2 to 20 carbon atoms, and mixtures thereof.

Preferred examples of monomers (M-2) include dimethylaminomethylmethacrylate, diethylaminomethylmethacrylate, dimethylaminoethylmethacrylate, diethylaminoethylmethacrylate, 2-methyl-5-vinylpyridine, morpholinomethylmethacrylate, morpholinoethylmethacrylate, N-vinylpyrrolidone, and mixtures thereof.

There is no particular restriction on the copolymerization molar ratio of a copolymer of monomers (M-1) and (M-2). However, preferably, monomer (M-1):monomer (M-2)=80:20 to 95:5. Any copolymerization method may be used. For example, such copolymers are generally produced with ease by radical-solution polymerization of monomers (M-1) with monomers (M-2) in the presence of a polymerization initiator such as benzoyl peroxide.

The PSSI (Permanent Shear Stability Index) of the viscosity index improver is preferably 10 or greater, more preferably 20 or greater, more preferably 30 or greater, particularly preferably 40 or greater because a viscosity index improver with a too less PSSI is less effective in increasing the viscosity index of the resulting composition and in improving fuel efficiency. On the other hand, the PSSI is preferably 100 or less, more preferably 80 or less, particularly preferably 60 or less because a viscosity index improver with a too high PSSI deteriorates the shear stability of the resulting composition.

The "PSSI" denotes "Permanent Shear Stability Index" of a polymer calculated on the basis of the data measured in accordance with ASTM D 6022-01 (Standard Practice for Calculation of Permanent Shear Stability Index) with ASTM D 6278-02 (Test Method for Shear Stability of Polymer Containing Fluids Using a European Diesel Injector Apparatus).

In the present invention, the viscosity index improver is necessarily contained in such an amount that the viscosity index of the resulting composition will be 160 or greater. The viscosity index improver is contained in such an amount that the viscosity index of the resulting composition will be preferably 180 or greater, more preferably 190 or greater, more preferably 200 or greater. There is no particular restriction on the upper limit. However, it is usually 300 or less. Inclusion of the viscosity index improver in such an amount that the viscosity index of the resulting composition will be 160 or greater enables the composition to be lowered in viscosity in the actual use temperature region and thus to be improved in fuel efficiency.

In the present invention, it is preferable to use polymethacrylates with a PSSI of 10 or greater as the viscosity index improver which is particularly preferably contained in such an amount that the viscosity index of the resulting composition will be 190 or greater.

Component (A) used in the present invention is a metallic detergent with a metal ratio of 3 or less.

Examples of the metallic detergent include alkali metal or alkaline earth metal sulfonates, alkali metal or alkaline earth metal phenates, alkali metal or alkaline earth metal salicylates, and alkali metal or alkaline earth metal carboxylates. In the present invention, one or more types of alkali metal or alkaline earth metal detergents, in particular alkaline earth metal detergents, selected from the above detergents are preferably used.

Examples of the alkali metal or alkaline earth metal sulfonate include alkali metal or alkaline earth metal salts, particularly preferably magnesium and/or calcium salts, of alkyl aromatic sulfonic acids, produced by sulfonating an alkyl aromatic compound having a molecular weight of 300 to 1,500, preferably 400 to 700.

Specific examples of the alkyl aromatic sulfonic acids include petroleum sulfonic acids and synthetic sulfonic acids.

The petroleum sulfonic acids may be those produced by sulfonating an alkyl aromatic compound contained in the lubricant fraction of a mineral oil or may be mahogany acid by-produced upon production of white oil. The synthetic sulfonic acids may be those produced by sulfonating an alkyl benzene having a straight-chain or branched alkyl group, produced as a by-product from a plant for producing an alkyl benzene used as the raw material of a detergent or produced by alkylating oligomer of olefin having 2 to 12 carbon atoms (ethylene, propylene) to benzene, or those produced by sulfonating dinonylnaphthalene. There is no particular restriction on the sulfonating agent used for sulfonating these alkyl aromatic compounds. The sulfonating agent may be a fuming sulfuric acid or sulfuric acid.

Examples of the alkali metal or alkaline earth metal phenates include alkali metal and alkaline earth metal salts, particularly magnesium salts and calcium salts of alkylphenols, alkylphenolsulfides or the Mannich reaction products of alkylphenols. Specific examples are those represented by formulas (6) through (8):

(6)

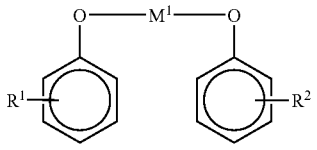

(7)

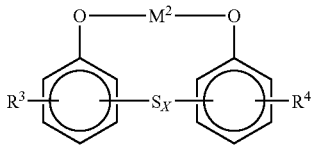

-continued (8)

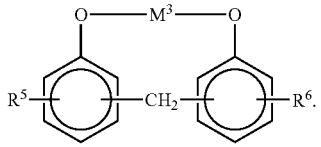

In formulas (6), (7), and (8), $R^1$, $R^2$, $R^3$, $R^4$, $R^5$, and $R^6$ are each independently a straight-chain or branched alkyl group having 4 to 30, preferably 6 to 18 carbon atoms, $M^1$, $M^2$, and $M^3$ are each independently an alkaline earth metal, preferably calcium and magnesium, and x is an integer of 1 or 2.

Specific examples of the alkyl group for $R^1$, $R^2$, $R^3$, $R^4$, $R^5$, and $R^6$ are butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups. These alkyl groups may be straight-chain or branched and may be of primary, secondary, or tertiary.

Examples of the alkali metal or alkaline earth metal salicylates include alkali metal or alkaline earth metal salts, preferably magnesium and calcium salts of an alkyl salicylic acid. Specific examples include compounds represented by formula (9):

(9)

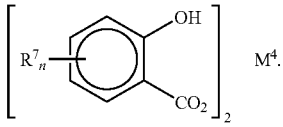

In formula (9), $R^7$ is a straight-chain or branched alkyl group having 1 to 30, preferably 4 to 30, more preferably 6 to 18 carbon atoms, $M^4$ is an alkaline earth metal, preferably calcium or magnesium, and n is an integer of 1 to 4, preferably 1 or 2.

Specific examples of the alkyl group for $R^7$ include methyl ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups. These alkyl groups may be straight-chain or branched and may be of primary, secondary or tertiary but are particularly preferably secondary alkyl groups. In the present invention, the alkyl salicylic acid constituting the alkali metal or alkaline earth metal thereof is preferably an alkyl salicylic acid containing preferably 50 percent by mole or more, more preferably 55 percent by mole or more of an alkyl salicylic acid having an alkyl group at least at 3-position. The alkyl salicylic acid is preferably an alkyl salicylic acid containing preferably 2 percent by mole or more, more preferably 5 percent by mole or more of dialkyl salicylic acid having alkyl groups at 3- and 5-positions. Preferred examples of the 3,5-dialkyl salicylic acid include dialkyl salicylic acids having two alkyl groups having 10 to 30 carbon atoms and dialkyl salicylic acids having an alkyl group having 1 to 9, preferably 1 to 4 carbon atoms and an alkyl group having 10 to 30 carbon atoms (for example, 3-alkyl-5-methyl salicylic acid).

Examples of the alkali metal or alkaline earth metal carboxylate include alkali metal and alkaline earth metal salts, particularly magnesium salts and calcium salts of aliphatic carboxylic acids and alicyclic carboxylic acid each having 4 to 30, preferably 6 to 18 carbon atoms. Specific examples include calcium oleate and calcium (iso)stearate.

The alkali metal or alkaline earth metal sulfonates, alkali metal or alkaline earth metal phenates, alkali metal or alkaline earth metal salicylates and alkali metal or alkaline earth metal carboxylates include neutral salts (normal salts) produced by reacting alkyl aromatic sulfonic acids, alkylphenols, alkylphenolsulfides, Mannich reaction products of alkylphenols, alkylsalicylic acids, or carboxylic acid directly with a metal base such as an alkali metal or alkaline earth metal oxide or hydroxide or produced by converting alkyl aromatic sulfonic acids, alkylphenols, alkylphenolsulfides, Mannich reaction products of alkylphenols, alkylsalicylic acids, or carboxylic acid to alkali metal salts such as sodium salts and potassium salts, followed by substitution with an alkaline earth metal salt; basic salts produced by heating these neutral salts with an excess amount of an alkali metal or alkaline earth metal salt or an alkali metal or alkaline earth metal base (alkali metal or alkaline earth metal hydroxide or oxide) in the presence of water; and overbased salts (superbasic salts) produced by reacting these neutral salts with a base such as an alkali metal or alkaline earth metal hydroxide in the presence of carbonic acid gas, boric acid or borate. These reactions are generally carried out in a solvent (aliphatic hydrocarbon solvents such as hexane, aromatic hydrocarbon solvents such as xylene, and light lubricating base oil).

Although metallic detergents are usually commercially available as diluted with a light lubricating base oil, it is preferred to use metallic detergents whose metal content is within the range of 1.0 to 20 percent by mass, preferably 2.0 to 16 percent by mass.

Although the base number of the alkaline earth metal detergent is arbitrary, it is usually from 0 to 500 mgKOH/g, preferably from 150 to 450 mgKOH/g.

The term "base number" used herein denotes a base number measured by the perchloric acid potentiometric titration method in accordance with section 7 of JIS K2501 "Petroleum products and lubricants-Determination of neutralization number".

In the present invention, a metallic detergent with a metal ratio of 3 or less is used as Component (A). The metal ratio is preferably 2.6 or less, more preferably 2 or less, particularly preferably 1.5 or less. In the present invention, preferable metallic detergents with a metal ratio of 3 or less are various above-described metallic detergents. However, preferably, alkaline earth metal sulfonates and/or alkaline earth metal phenates, particularly preferably alkaline earth metal sulfonates are used because they can easily inhibit the deterioration of anti-wear properties or the increase of acid number. The use of Component (A) with the component structure as described above can enhance effects to improve base number retention properties, high-temperature detergency and low friction characteristics.

The term "metal ratio" used herein is represented by "valence of metal element×metal element content (mol)/soap group (group such as alkyl salicylic acid group) content (mol)". That is, the metal ratio indicates the alkali metal or alkaline earth metal content with respect to the alkyl salicylic acid group or alkyl sulfonic acid group content in the alkali metal or alkaline earth metal detergent.

In addition to Component (A), the composition of the present invention may further contain a metallic detergent with a metal ratio of greater than 3, preferably 5 or greater, more preferably 8 or greater and preferably 40 or less, more preferably 20 or less, more preferably 15 or less. Preferable examples of such metallic detergent with a metal ratio of greater than 3 include the above-described various metallic detergents. However, preferably alkaline earth metal sulfonates and/or alkaline earth metal phenates, particularly preferably alkaline earth metal sulfonates are used because they can easily inhibit the deterioration of anti-wear properties or the increase of acid number. In particular, when an alkaline earth metal sulfonate and/or an alkaline earth metal phenate are used as Component (A), it is desirous to use an alkaline earth metal sulfonate and/or an alkaline earth metal phenate as the metallic detergent with a metal ratio of greater than 3 because they are excellent in storage stability.

The blend ratio of the metallic detergent with a metal ratio of greater than 3 is the metallic detergent with a metal ratio of greater than 3: the metallic detergent with a metal ratio of 3 or less within the range of preferably 10 to 90 percent by mass: 90 to 10 percent by mass, more preferably 40 to 85 percent by mass: 60 to 15 percent by mass, more preferably 50 to 80 percent by mass: 50 to 20 percent by mass, in terms of the total metal content originating from the metallic detergents.

The total content of the metallic detergents in the composition of the present invention is preferably from 0.01 to 0.2 percent by mass, more preferably from 0.05 to 0.16 percent by mass, more preferably from 0.08 to 0.12 percent by mass in terms of alkali metal or alkaline earth metal element, on the basis of the total mass of the composition. When the content of the metallic detergent is less than 0.05 percent by mass, the resulting composition would fail to exhibit excellent base number retention properties and high-temperature detergency as achieved with the composition of the present invention. The content of the metallic detergent of more than 0.2 percent by mass is not also preferable because the sulfated ash content of the resulting composition can not be within the range intended by the invention.

Component (B) used in the present invention is a sulfur-free phosphorus compound. Specific examples include sulfur-free phosphorus-containing acids and metal salts thereof.

Examples of sulfur-free phosphorus-containing acids include compounds represented by formulas (10) and (11) below. Examples of the metal salts include those of such sulfur-free phosphorus-containing acids and metal bases such as metal oxides, metal hydroxides, metal carbonates and metal chlorides:

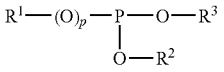

(10)

wherein $R^1$ is a hydrocarbon group having 1 to 30 carbon atoms, $R^2$ and $R^3$ may be the same or different and are each independently hydrogen or a hydrocarbon group having 1 to 30 carbon atoms, and p is 0 or 1;

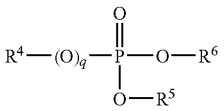

(11)

wherein $R^4$ is a hydrocarbon group having 1 to 30 carbon atoms, $R^5$ and $R^6$ may be the same or different and are each independently hydrogen or a hydrocarbon group having 1 to 30 carbon atoms, and q is 0 or 1.

Examples of the hydrocarbon groups having 1 to 30 carbon atoms for $R^1$ to $R^6$ include alkyl, cycloalkyl, alkenyl, alkyl-substituted cycloalkyl, aryl, alkyl-substituted aryl, and arylalkyl groups.

Specific examples of the alkyl group include those, which may be straight-chain or branched and may be of primary, secondary or tertiary, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl groups.

Examples of the cycloalkyl group include those having 5 to 7 carbon atoms such as cyclopentyl, cyclohexyl and cycloheptyl groups. Examples of the alkylcycloalkyl group include those, of which the alkyl groups may bond to any position of the cycloalkyl group, having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups.

Examples of the alkenyl group include those, which may be straight-chain or branched and the position of which the double bond may vary, such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, and octadecenyl groups.

Examples of the aryl group include phenyl and naphtyl groups. Examples of the alkylaryl group include those, of which the alkyl groups may be straight-chain or branched and bond to any position of the aryl group, having 7 to 18 carbon groups, such as tolyl, xylyl, ethylphenyl, propylphenyl, butylphenyl, pentylphenyl, hexylphenyl, heptylphenyl, octyphenyl, nonylphenyl, decylphenyl, undecylphenyl, and dodecylphenyl groups.

Examples of the arylalkyl group include those, of which the alkyl groups may be straight-chain or branched, having 7 to 12 carbon atoms, such as benzyl, phenylethyl, phenylpropyl, phenylbutyl, phenylpentyl and phenylhexyl groups.

The hydrocarbon group having 1 to 30 carbon atoms for $R^1$ to $R^6$ are preferably alkyl groups having 1 to 30 carbon atoms and aryl groups having 6 to 24 carbon atoms, more preferably alkyl groups having preferably 3 to 18, more preferably 4 to 12 carbon atoms.

Examples of the sulfur-free phosphorus-containing acids represented by formula (10) include phosphorous acid monoesters and (hydrocarbyl)phosphonous acid each having one of the hydrocarbon groups having 1 to 30 carbon atoms exemplified above; phosphorous acid diesters and (hydrocarbyl)phosphonous acid monoesters each having two of the hydrocarbon groups having 1 to 30 carbon atoms exemplified above; phosphorous acid triesters and (hydrocarbyl)phosphonous acid diesters each having three of the hydrocarbon groups having 1 to 30 carbon atoms exemplified above; and mixtures thereof. The term "hydrocarbyl" used herein denotes substitution by hydrocarbon group having 1 to 30 carbon atoms (hereinafter the same).

Examples of the sulfur-free phosphorus-containing acids represented by formula (11) include phosphoric acid monoesters and (hydrocarbyl)phosphonic acid each having one of the hydrocarbon groups having 1 to 30 carbon atoms exemplified above; phosphoric acid diesters and (hydrocarbyl)phosphonic acid monoesters each having two of the hydrocarbon groups having 1 to 30 carbon atoms exemplified above; phosphoric acid triesters and (hydrocarbyl)phosphonic acid diesters each having three of the hydrocarbon groups having 1 to 30 carbon atoms exemplified above; and mixtures thereof.

Metal salts of the sulfur-free phosphorus-containing acids represented by formulas (10) and (11) may be produced by allowing the acids to react with metal bases such as metal oxides, metal hydroxides, metal carbonates or metal chlorides and then neutralizing the whole or part of the remaining acid hydrogen.

Specific examples of the metals of the above-mentioned metal bases include alkali metals such as lithium, sodium, potassium, and cesium, alkaline earth metals such as calcium, magnesium, and barium, and heavy metals such as zinc, copper, iron, lead, nickel, silver, molybdenum and manganese. Among these metals, preferred are alkaline earth metals such as calcium and magnesium, molybdenum and zinc, and particularly preferred is zinc.

The above-described metal salts of phosphorus compounds vary in structure depending on the valence of the metals or the number of OH group of the phosphorus compounds. Therefore, there is no particular restriction on the structure of the metal salts of phosphorus compounds. For example, when 1 mol of zinc oxide is reacted with 2 mol of a phosphoric acid monoester (with one OH group), it is assumed that a compound with a structure represented by formula (12) below is produced as the main component but polymerized molecules may also exist:

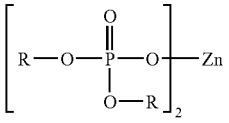

(12)

wherein Rs are each independently hydrogen or a hydrocarbon group having 1 to 30 carbon atoms.

For another example, when 1 mole of zinc oxide is reacted with 1 mole of a phosphoric acid monoester (two OH groups), it is assumed that a compound with a structure represented by formula (13) below is produced as the main component but polymerized molecules may also exist:

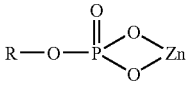

(13)

wherein R is hydrogen or a hydrocarbon group having 1 to 30 carbon atoms.

The content of Component (B) in the composition of the present invention is usually from 0.005 to 0.2 percent by mass, preferably from 0.01 to 0.1 percent by mass, more preferably from 0.04 to 0.08 percent by mass in terms of phosphorus, on the basis of the total mass of the composition. When the content of Component (B) is less than 0.05 percent by mass in terms of phosphorus, the resulting composition would be insufficient in anti-wear properties. When the content of Component (B) is in excess of 0.2 percent, the resulting composition would fail to attain effects as balanced with the content and be insufficient in dissolubility.

The composition of the present invention comprises a lubricating oil base and a viscosity index improver and further (A) a metallic detergent with a metal ratio of 3 or less and/or (B) a sulfur-free phosphorus compound. However, when the composition contains Component (B) but not Component (A), it may further contain a metallic detergent with a metal ratio of greater than 3. The metallic detergent with a metal ratio of greater than 3 may be contained in such an amount that the metal ratio and content thereof fall within the range of the total content of the above-described metallic detergent.

Preferably, the engine oil composition of the present invention may contain at least one type selected from the group consisting of ashless anti-oxidants, organic molybdenum compounds and ashless friction modifiers.

Examples of the ashless anti-oxidant include phenolic and/or aminic anti-oxidants.

Examples of the phenolic ashless anti-oxidants include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl) sulfide, 2,2'-thio-diethylenebis[3-(3,5-di-tert-butyl-4-hydroxyphenyl)propionate], octyl-3-(3,5-di-tert-butyl-4-hydroxyphenyl)propionate, tridecyl-3-(3,5-di-tert-butyl-4-hydroxyphenyl)propionate, pentaerythrityl-tetraquis[3-(3,5-di-tert-butyl-4-hydroxyphenyl)propionate], octadecyl-3-(3,5-di-tert-butyl-4-hydroxyphenyl)propionate, and mixtures thereof. Among these phenolic anti-oxidants, phenolic compounds with a molecular weight of 240 or greater are preferably used because they are high in decomposition temperature and thus can exhibit their effects under higher temperature conditions.

Specific examples of the aminic ashless dispersants include phenyl-α-naphtylamines, alkylphenyl-α-naphtylamines, dialkyldiphenylamines, N,N'-diphenyl-p-phenylene diamine, and mixtures thereof. Examples of the alkyl group include straight-chain or branched alkyl groups having 1 to 20 carbon atoms.

The content of an ashless dispersant if contained is preferably 0.1 percent by mass or more, more preferably 0.3 percent by mass or more, particularly preferably 0.4 percent by mass or more, on the basis of the total mass of the composition. The upper limit is preferably 5 percent by mass or less, more preferably 2.5 percent by mass or less, particularly preferably 2.0 percent by mass or less. The ashless anti-oxidant of 0.1 percent by mass or less renders it easy to retain the detergency of the resulting composition for a long period of time. The content of more than 5 percent by mass is not preferable because the resulting composition would be poor in storage stability.

Examples of the organic molybdenum compound used in the present invention include those containing sulfur such as molybdenum dithiophosphate and molybdenum dithiocarbamate.

Examples of molybdenum dithiophosphates include compounds represented by formula (14) below:

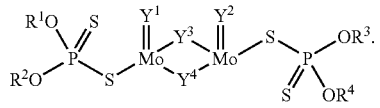

(14)

In formula (14), $R^1$, $R^2$, $R^3$, and $R^4$ may be the same or different and are each independently a hydrocarbon group such as alkyl groups having 2 to 30, preferably 5 to 18, more preferably 5 to 12 carbon atoms and an (alkyl)aryl group having 6 to 18, preferably 10 to 15 carbon atoms, and $Y^1$, $Y^2$, $Y^3$, and $Y^4$ are each independently sulfur or oxygen.

Preferred examples of the alkyl group include ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups, all of which may be primary, secondary, or tertiary alkyl groups and straight-chain or branched.

Preferred examples of the (alkyl)aryl groups include phenyl, tolyl, ethylphenyl, propylphenyl, butylphenyl, pentylphenyl, hexylphenyl, octylphenyl, nonylphenyl, decylphenyl, undecylphenyl, and dodecylphenyl groups, all of which alkyl groups may be primary, secondary or tertiary alkyl groups and straight-chain or branched. Furthermore, the (alkyl)aryl groups include all positional isomers wherein the aryl group may possess an alkyl substituent at any position.

Specific examples of molybdenum dithiophophates include sulfurized molybdenum diethyldithiophosphate, sulfurized molybdenum dipropyldithiophosphate, sulfurized molybdenum dibutyldithiophosphate, sulfurized molybdenum dipentyldithiophosphate, sulfurized molybdenum dihexyldithiophosphate, sulfurized molybdenum dioctyldithiophosphate, sulfurized molybdenum didecyldithiophosphate, sulfurized molybdenum didodecyldithiophosphate, sulfurized molybdenum di(butylphenyl) dithiophosphate, sulfurized molybdenum di(nonylphenyl) dithiophosphate, sulfurized oxymolybdenum diethyldithiophosphate, sulfurized oxymolybdenum dipropyldithiophosphate, sulfurized oxymolybdenum dibutyldithiophosphate, sulfurized oxymolybdenum dipentyldithiophosphate, sulfurized oxymolybdenum dihexyldithiophosphate, sulfurized oxymolybdenum dioctyldithiophosphate, sulfurized oxymolybdenum didecyldithiophosphate, sulfurized oxymolybdenum didodecyldithiophosphate, sulfurized oxymolybdenum di(butylphenyl)dithiophosphate, sulfurized oxymolybdenum di(nonylphenyl)dithiophosphate, all of which the alkyl groups may be straight-chain or branched and the alkyl groups may bond to any position of the phenyl groups, and mixtures thereof. Furthermore, the molybdenum dithiophosphate may be those having in per molecule hydrocarbon groups each having a different carbon number and/or structure from each other.

Examples of molybdenum dithiocarbamate include compounds represented by formula (15) below:

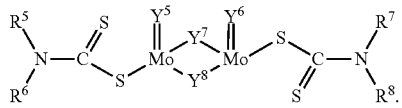

(15)

In formula (15), $R^5$, $R^6$, $R^7$, and $R^8$ may be the same or different and are each independently a hydrocarbon group such as an alkyl group having 2 to 24, preferably 4 to 13 and an (alkyl)aryl group having 6 to 24, preferably 10 to 15 carbon atoms, and $Y^5$, $Y^6$, $Y^7$, and $Y^8$ are each independently sulfur or oxygen.

Preferred examples of the alkyl group include ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups, all of which may be primary, secondary, or tertiary alkyl groups and straight-chain or branched.

Preferred examples of the (alkyl)aryl groups include phenyl, tolyl, ethylphenyl, propylphenyl, butylphenyl, pentylphenyl, hexylphenyl, octylphenyl, nonylphenyl, decylphenyl, undecylphenyl, and dodecylphenyl groups, all of which alkyl groups may be primary, secondary or tertiary alkyl groups and straight-chain or branched. Furthermore, these (alkyl)aryl groups include all positional isomers wherein the aryl group may possess an alkyl substituent at any position. Examples of molybdenum dithiocarbamates with structures other than those described above include those having a structure that a thio- or polythio-trinuclear molybdenum comprises bonded thereto ligands such as dithiocarbamates, as disclosed in WO98/26030 and WO99/31113.

Specific examples of the molybdenum dithiocarbamates include sulfurized molybdenum diethyldithiocarbamate, sulfurized molybdenum dipropyldithiocarbamate, sulfurized molybdenum dibutyldithiocarbamate, sulfurized molybdenum dipentyldithiocarbamate, sulfurized molybdenum dihexyldithiocarbamate, sulfurized molybdenum dioctyldithiocarbamate, sulfurized molybdenum didecyldithiocarbamate, sulfurized molybdenum didodecyldithiocarbamate, sulfurized molybdenum di(butylphenyl) dithiocarbamate, sulfurized molybdenum di(nonylphenyl) dithiocarbamate, sulfurized oxymolybdenum diethyldithiocarbamate, sulfurized oxymolybdenum dipropyldithiocarbamate, sulfurized oxymolybdenum dibutyldithiocarbamate, sulfurized oxymolybdenum dipentyldithiocarbamate, sulfurized oxymolybdenum dihexyldithiocarbamate, sulfurized oxymolybdenum dioctyldithiocarbamate, sulfurized oxymolybdenum didecyldithiocarbamate, sulfurized oxymolybdenum didodecyldithiocarbamate, sulfurized oxymolybdenum di(butylphenyl)dithiocarbamate, sulfurized oxymolybdenum di(nonylphenyl)dithiocarbamate, all of which the alkyl groups may be straight-chain or branched and the alkyl groups may bond to any position of the phenyl groups, and mixtures thereof. Furthermore, those having in one molecule hydrocarbon groups each having a different carbon number and/or structure from each other are also preferably used as the molybdenum dithiocarbamate.

Examples of sulfur-containing organic molybdenum compounds other than those exemplified above include complexes of molybdenum compounds (for example, molybdenum oxides such as molybdenum dioxide and molybdenum trioxide, molybdic acids such as orthomolybdic acid, paramolybdic acid, and sulfurized (poly)molybdic acid, metal salts of these molybdic acids, molybdic acid salts such as ammonium salts of these molybdic acids, molybdenum sulfides such as molybdenum disulfide, molybdenum trisulfide, molybdenum pentasulfide, and molybdenum polysulfide, sulfurized molybdenum acid, metal and amine salts of sulfurized molybdenum acid, and halogenated molybdenum such as molybdenum chloride) and sulfur-containing organic compounds (for example, alkyl(thio)xanthate, thiaziazole, mercaptothiadiazole, thiocarbonate, tetrahydrocarbylthiuramdisulfide, bis(di(thio)hydrocarbyldithiophosphonate) disulfide, organic (poly)sulfide, and sulfurized esters) or other organic compounds; complexes of sulfur-containing molybdenum compounds such as the above-mentioned molybdenum sulfides and sulfurized molybdenum acid and amine compounds, succinimides, organic acids, or alcohols, described below with respect to the organic molybdenum compounds containing no sulfur as a constituent; and sulfur-containing organic molybdenum compounds produced by reacting sulfur sources such as elemental sulfur, hydrogen sulfide, phosphorus pentasulfide, sulfur oxide, inorganic sulfides, hydrocarbyl (poly)sulfides, sulfurized olefins, sulfurized esters, sulfurized waxes, sulfurized carboxylic acids, sulfurized alkylphenols, thioacetamide, and thiourea, molybdenum compounds containing no sulfur as a constituent described below and sulfur-free organic compounds such as amine compounds, succinimides, organic acids and alcohols described below with respect to the molybdenum compounds containing no sulfur as a constituent. More specific examples of these sulfur-containing organic molybdenum compounds are described in Japanese Patent Laid-Open Publication No. 56-10591 and U.S. Pat. No. 4,263,152 in detail.

Alternatively, the organic molybdenum compound may be an organic molybdenum compound containing no sulfur as a constituent.

Specific examples of the organic molybdenum compounds containing no sulfur as a constituent include molybdenum-amine complexes, molybdenum-succinimide complexes, molybdenum salts of organic acids, and molybdenum salts of alcohols. Preferred examples include molybdenum-amine complexes, molybdenum salts of organic acids, and molybdenum salts of alcohols.

Examples of the molybdenum compounds constituting the above-mentioned molybdenum-amine complexes include molybdenum compounds containing no sulfur such as molybdenum trioxide and hydrate thereof ($MoO_3.nH_2O$), molybdic acids ($H_2MoO_4$), alkali metal salts of molybdic acids ($M_2MoO_4$, wherein M indicates an alkali metal), ammonium molybdate ($(NH_4)_2MoO_4$ or $(NH_4)_6[Mo_7O_{24}].4H_2O$), $MoCl_5$, $MoOCl_4$, $MoO_2Cl_2$, $MoO_2Br_2$, and $Mo_2O_3Cl_6$. Among these, preferred are hexavalent molybdenum compounds in view of the yield of the molybdenum-amine complexes. More preferred among the hexavalent molybdenum compounds are molybdenum trioxide and hydrate thereof, molybdic acids, alkali metal salts of molybdic acids and ammonium molybdate in view of availability.

There is no particular restriction on the amine compound constituting the molybdenum-amine complex. Specific examples of nitrogen compounds include monoamines, diamines, polyamines, and alkanolamines. More specific examples include alkylamines having a straight-chain or branched alkyl group having 1 to 30 carbon atoms, such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; alkenylamines having a straight-chain or branched alkenyl group having 2 to 30 carbon atoms, such as ethenylamine, propenylamine, butenylamine, octenylamine, and oleylamine; alkanolamines having a straight-chain or branched alkanol group having 1 to 30 carbon atoms, such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine, and propanolbutanolamine; alkylenediamines having an alkylene group having 1 to 30 carbon atoms, such as methylenediamine, ethylenediamine, propylenediamine, and butylenediamine; polyamines such as diethylenetriamine, triethylenetetramine, tetraethylenepentamine, and pentaethylenehexamine; heterocyclic compounds such as those having an alkyl or alkenyl group having 8 to 20 carbon atoms bonded to the above-exemplified monoamines, diamines and polyamines, such as undecyldiethylamine, undecyldiethanolamine, dodecyldipropanolamine, oleyldiethanolamine, oleylpropylenediamine, and stearyltetraethylenepentamine and imidazoline; alkyleneoxide adducts thereof; and mixtures thereof. Among these amine compounds, preferred examples include primary amines, secondary amines, and alkanolamines.

The carbon number of the amine compound constituting the molybdenum-amine complex is preferably 4 or greater, more preferably from 4 to 30, particularly preferably from 8 to 18. An amine compound having fewer than 4 carbon atoms would tend to be poor in dissolubility. The use of an amine compound having 30 or fewer carbon atoms can relatively increase the content of molybdenum in the molybdenum-amine complex, enabling the advantageous effects of the present invention to enhance even if the complex is added in a small amount.

Examples of the molybdenum-succinimide complex include complexes of the sulfur-free molybdenum compounds exemplified with respect to the above molybdenum-amine complex and succinimides having an alkyl or alkenyl group having 4 or more carbon atoms. Examples of the succinimides include succinimides having in their molecules at least one alkyl or alkenyl group having 40 to 400 carbon atoms and derivatives thereof as exemplified with respect to the ashless dispersant described below and those having an alkyl or alkenyl group having 4 to 39, preferably 8 to 18 carbon atoms. A succinimide having fewer than 4 carbon atoms would tend to be poor in dissolubility. A succinimide having an alkyl or alkenyl group having more than 30 but 400 or fewer carbon atoms may be used. However, the use of a succinimide having 30 or fewer carbon atoms can relatively increase the content of molybdenum in the molybdenum-amine complex, enabling the advantageous effects of the present invention to enhance even if the complex is added in a small amount.

Examples of the molybdenum salts of organic acids include salts of molybdenum bases such as molybdenum oxide or hydroxide exemplified with respect to the molybdenum-amine complex, molybdenum carbonate and molybdenum chlorides and organic acids. The organic acids are preferably phosphorus-containing acids represented by formulas (10) and (11) or carboxylic acids.

The carboxylic acid constituting the molybdenum salt of a carboxylic acid may be a monobasic acid or a polybasic acid.

Examples of the monobasic acid include fatty acids having usually 2 to 30, preferably 4 to 24 carbon atoms, which may be straight-chain or branched and saturated or unsaturated. Specific examples include saturated fatty acids such as acetic acid, propionic acid, straight-chain or branched butanoic acid, straight-chain or branched pentanoic acid, straight-chain or branched hexanoic acid, straight-chain or branched heptanoic acid, straight-chain or branched octanonic acid, straight-chain or branched nonanoic acid, straight-chain or branched decanoic acid, straight-chain or branched undecanoic acid, straight-chain or branched dodecanoic acid, straight-chain or branched tridecanoic acid, straight-chain or branched tetradecanoic acid, straight-chain or branched pentadecanoic acid, straight-chain or branched hexadecanoic acid, straight-chain or branched heptadecanoic acid, straight-chain or branched octadecanoic acid, straight-chain or branched hydroxyoctadecanoic acid, straight-chain or branched nonadecanoic acid, straight-chain or branched eicosanoic acid, straight-chain or branched heneicosanoic acid, straight-chain or branched docosanoic acid, straight-chain or branched tricosanoic acid, and straight-chain or branched tetracosanoic acid; unsaturated fatty acids such as acrylic acid, straight-chain or branched butenoic acid, straight-chain or branched pentenoic acid, straight-chain or branched hexenoic acid, straight-chain or branched heptenoic acid, straight-chain or branched octenoic acid, straight-chain or branched nonenoic acid, straight-chain or branched decenoic acid, straight-chain or branched undecenoic acid, straight-chain or branched dodecenoic acid, straight-chain or branched tridecenoic acid, straight-chain or branched tetradecenoic acid, straight-chain or branched pentadecenoic acid, straight-chain or branched hexadecenoic acid, straight-chain or branched heptadecenoic acid, straight-chain or branched octadecenoic acid, straight-chain or branched hydroxyoctadecenoic acid, straight-chain or branched nonadecenoic acid, straight-chain or branched eicosenic acid, straight-chain or branched heneicosenic acid, straight-chain or branched docosenic acid, straight-chain or branched tircosenic acid, and straight-chain or branched tetracosenic acid; and mixtures thereof.

Other than the above-exemplified fatty acids, the monobasic acid may be a monocylic or polycyclic carboxylic acid (may have a hydroxyl group). The carbon number of the monocylic or polycyclic carboxylic acid is preferably from 4 to 30, more preferably from 7 to 30. Examples of the monocylic or polycyclic carboxylic acid include aromatic or cycloalkyl carboxylic acids having 0 to 3, preferably 1 or 2 straight-chain or branched alkyl groups having 1 to 30, preferably 1 to 20 carbon atoms. More specific examples include (alkyl)benzene carboxylic acids, (alkyl)naphthalene carboxylic acids, and (alkyl)cycloalkyl carboxylic acids. Preferred examples of the monocylic or polycyclic carboxylic acid include benzoic acid, salicylic acid, alkylbenzoic acid, alkylsalicylic acid, and cyclohexane carboxylic acid.

Examples of the polybasic acid include dibasic acids, tribasic acid, and tetrabasic acids. The polybasic acid may be a chain or cyclic polybasic acid. The chain polybasic acid may be straight-chain or branched and saturated or unsaturated. The chain polybasic acid is preferably a chain dibasic acid having 2 to 16 carbon atoms. Specific examples include ethanedioic acid, propanedioic acid, straight-chain or branched butanedioic acid, straight-chain or branched pentanedioic acid, straight-chain or branched hexanedioic acid, straight-chain or branched heptanedioic acid, straight-chain or branched octanedioic acid, straight-chain or branched nonanedioic acid, straight-chain or branched decanedioic acid, straight-chain or branched undecanedioic acid, straight-chain or branched dodecandioic acid, straight-chain or branched tridecanedioic acid, straight-chain or branched tetradecanedioic acid, straight-chain or branched heptadecanedioic acid, straight-chain or branched hexadecanedioic acid, straight-chain or branched straight-chain or branched hexenedioic acid, straight-chain or branched heptenedioic acid, straight-chain or branched octenedioic acid, straight-chain or branched nonenedioic acid, straight-chain or branched decenedioic acid, straight-chain or branched undecenedioic acid, straight-chain or branched dodecenedioic acid, straight-chain or branched tridecenedioic acid, straight-chain or branched tetradecenedioic acid, straight-chain or branched heptadecenedioic acid, straight-chain or branched hexadecenedioic acid, alkenylsuccinic acids, and mixtures thereof. Examples of the cyclic polybasic acids include alicyclic dicarboxylic acids such as 1,2-cyclohexane dicarboxylic acid and 4-cyclohexene-1,2-dicarboxylic acid, aromatic dicarboxylic acids such as phthalic acid, aromatic tricarboxylic acids such as trimellitic acid, and aromatic tetracarboxylic acids such as pyromellitic acid.

Examples of the molybdenum salts of alcohols include salts of the sulfur-free molybdenum compounds exemplified with respect to the molybdenum-amine complexes and alcohols. Examples of the alcohols include monohydric alcohols, polyhydric alcohols, partial esters or partial etherified compounds of polyhydric alcohols, and nitrogen compounds having a hydroxyl group (alkanolamines). Molybdic acid is a strong acid and thus forms an ester by reacting with an alcohol. Such an ester is also included within the molybdenum salts of alcohols defined by the present invention.

The monohydric alcohols may be those having usually 1 to 24, preferably 1 to 12, more preferably 1 to 8 carbon atoms. Such alcohols may be straight-chain or branched and saturated or unsaturated. Specific examples of alcohols having 1 to 24 carbon atoms include methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, straight-chain or branched nonadecanol, straight-chain or branched eicosanol, straight-chain or branched heneicosanol, straight-chain or branched tricosanol, straight-chain or branched tetracosanol, and mixtures thereof.

The polyhydric alcohols may be those of usually dihydric to decahydric, preferably dihydric to hexahydric. Specific examples of the polyhydric alcohols of dihydric to decahydric include dihydric alcohols such as ethylene glycol, diethylene glycol, polyethylene glycol (trimer to pentadecamer of ethylene glycol), propylene glycol, dipropylene glycol, polypropylene glycol (trimer to pentadecamer of propyleneglycol), 1,3-propanedioil, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol, and neopentyl glycol; polyhydric alcohols such as glycerin, polyglycerin (dimer to octamer thereof, such as diglycerin, triglycerin, and tetraglycerin), trimethylolalkanes (trimethylolethane, trimethylolpropane, trimethylolbutane) and dimers to octamers thereof, pentaerythritol and dimers to tetramers thereof, 1,2,4-butanetriol, 1,3,5-pentanetriol, 1,2,6-hexanetriol, 1,2,3,4-butanetetrol, sorbitol, sorbitan, sorbitol-glycerin condensate, adonitol, arabitol, xylitol, and mannitol; saccharide such as xylose, arabinose, ribose, rhamnose, glucose, fructose, galactose, mannose, sorbose, cellobiose, maltose, isomaltose, trehalose, and sucrose; and mixtures thereof.

Examples of the partial esters of polyhydric alcohols include compounds produced by hydrocarbyl-esterifying a part of the hydroxyl groups of any of the above-exemplified polyhydric alcohols. Among such compounds, preferred examples include glycerin monooleate, glycerin dioleate, sorbitan monooleate, sorbitan dioleate, pentaerythritol monooleate, polyethylene glycol monooleate, and polyglycerin monooleate.

Examples of the partial ethers of polyhydric alcohols include compounds produced by hydrocarbyl-esterifying a part of the hydroxyl groups of any of the above-exemplified polyhydric alcohols and compounds wherein an ether bond is formed by condensation of the polyhydric alcohols with one another (sorbitan condensate or the like). Among these compounds, preferred examples include 3-octadecyloxy-1,2-propanediol, 3-octadecenyloxy-1,2-propanediol, and polyethylene glycol alkylethers.

Examples of the nitrogen compounds having a hydroxyl group include the alkanolamines exemplified with respect to the above-described molybdenum-amine complex and alkanolamides (diethanolamide) wherein the amide group of the alkanolamines is amidized. Among these compounds, preferred examples include stearyl diethanolamine, polyethylene glycol stearylamine, polyethylene glycol dioleylamine, hydroxyethyl laurylamine, and oleic acid diethanolamide.

Preferred examples of the sulfur-containing organic molybdenum compounds in the present invention include molybdenum dithiocarbamates and molybdenum dithiophosphates because they are excellent in friction reducing effect. It is also desirable to use reaction products of the above-described sulfur sources, molybdenum compounds containing no sulfur as a constituent, and sulfur-free organic compounds (succinimide) or the above-described organic molybdenum compounds containing no sulfur as a constituent because they are excellent in anti-oxidation effect and can reduce deposits on the top ring grooves of an diesel engine.

When the organic molybdenum compound is used in the present invention, there is no particular restriction on the content thereof. However, the content is preferably from 0.001 percent by mass or more, more preferably 0.005 percent by mass or more, more preferably 0.01 percent by mass or more, and preferably 0.2 percent by mass or less, more preferably 0.1 percent by mass or less, more preferably 0.05 percent by mass or less, particularly preferably 0.03 percent by mass or less, in terms of molybdenum, on the basis of the total mass of the composition. When the organic molybdenum compound is used in an amount of less than 0.001 percent by mass, the resulting composition would be insufficient in thermal/oxidation stability and fail to maintain excellent detergency for a long period of time. Whereas, when the organic molybdenum compound is used in an amount in excess of 0.2 percent by mass, the resulting composition would fail to exhibit its advantageous effects as balanced with the content and poor in storage stability.

The ashless friction modifier which may be used in the present invention may be any compound that are usually used as a friction modifier for lubricating oils. Examples of the ashless friction modifier include ashless friction modifiers such as amine compounds, fatty acid esters, fatty acid amides, fatty acids, aliphatic alcohols, and aliphatic ethers, each having at least one alkyl or alkenyl group having 6 to 30 carbon atoms, in particular straight-chain alkyl or alkenyl group having 6 to 30 carbon atoms per molecule. Alternatively, the ashless friction modifier may be one or more type of compound selected from nitrogen-containing compounds represented by formulas (16) and (17) below or various ashless friction modifiers having two or more nitrogens per molecule, as exemplified in International Publication No. 2005/037967 Pamphlet. These various ashless friction modifiers are particularly preferable because they are unlikely to be deteriorated in friction reducing effect even when the resulting oil is contaminated with soot and can maintain the effect for a long period of time.

(16)

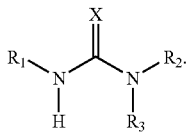

In formula (16), $R_1$ is a hydrocarbon or functionalized hydrocarbon group having 1 to 30 carbon atoms, preferably a hydrocarbon or functionalized hydrocarbon group having 10 to 30 carbon atoms, more preferably an alkyl, alkenyl or functionalized hydrocarbon group having 12 to 20 carbon atoms, and particularly preferably an alkenyl group having 12 to 20 carbon atoms, $R_2$ and $R_3$ are each independently a hydrocarbon or functionalized hydrocarbon group having 1 to 30 carbon atoms or hydrogen, preferably a hydrocarbon or functionalized hydrocarbon group having 1 to 10 carbon atoms or hydrogen, more preferably a hydrocarbon group having 1 to 4 carbon atoms or hydrogen, and even more preferably hydrogen, and X is oxygen or sulfur, preferably oxygen. Most preferred examples of nitrogen-containing compounds represented by formula (16) include those wherein X is oxygen and acid-modified derivatives thereof. More specific examples include urea compounds having at least one alkyl or alkenyl group having 12 to 20 carbon atoms, wherein X is oxygen, $R_1$ is an alkyl or alkenyl group having 12 to 20 carbon atoms, and $R_2$ and $R_3$ are each hydrogen, such as dodecyl urea, tridecyl urea, tetradecyl urea, pentadecyl urea, hexadecyl urea, heptadecyl urea, octadecyl urea, and oleyl urea, and acid-modified derivatives thereof.

(17)

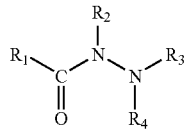

In formula (17), $R_1$ is a hydrocarbon or functionalized hydrocarbon group having 1 to 30 carbon atoms, preferably a hydrocarbon or functionalized hydrocarbon group having 10 to 30 carbon atoms, more preferably an alkyl, alkenyl or functionalized hydrocarbon group having 12 to 20 carbon atoms, and particularly preferably an alkenyl group having 12 to 20 carbon atoms, and $R_2$ through $R_4$ are each independently a hydrocarbon or functionalized hydrocarbon group having 1 to 30 carbon atoms or hydrogen, preferably a hydrocarbon or functionalized hydrocarbon group having 1 to 10 carbon atoms or hydrogen, more preferably a hydrocarbon group having 1 to 4 carbon atoms or hydrogen, more preferably hydrogen.

Specific examples of nitrogen-containing compounds represented by formula (17) include hydrazides having a hydrocarbon or functionalized hydrocarbon group having 1 to 30 carbon atoms, and derivatives thereof. The nitrogen-containing compounds are hydrazides having a hydrocarbon or functionalized hydrocarbon group having 1 to 30 carbon atoms when $R_1$ is a hydrocarbon or functionalized hydrocarbon group having 1 to 30 carbon atoms, and $R_2$ through $R_4$ are each hydrogen. The nitrogen-containing compounds are N-hydrocarbyl hydrazides (hydrocarbyl denotes hydrocarbon group) having a hydrocarbon or functionalized hydrocarbon group having 1 to 30 carbon atoms when $R_1$ and either one of $R_2$ through $R_4$ are each a hydrocarbon or functionalized hydrocarbon group having 1 to 30 carbon atoms and the rest of $R_2$ through $R_4$ are each hydrogen. Most preferable examples of nitrogen-containing compounds represented by formula (17) include hydrazide compounds having an alkyl or alkenyl group having 12 to 20 carbon atoms, wherein $R_1$ is an alkyl or alkenyl group having 12 to 20 carbon atoms and $R_2$, $R_3$ and $R_4$ are each hydrogen, such as dodecanoic acid hydrazide, tridecanoic acid hydrazide, tetradecanoic acid hydrazide, pentadecanoic acid hydrazide, hexadecanoic acid hydrazide, heptadecanoic acid hydrazide, octadecanoic acid hydrazide, and oleic acid hydrazide and acid-modified derivatives thereof.

The content of the ashless friction modifier in the engine oil of the present invention is preferably 0.01 percent by mass or more, more preferably 0.1 percent by mass or more, more preferably 0.3 percent by mass or more and preferably 3 percent by mass or less, more preferably 2 percent by mass or less, more preferably 1 percent by mass or less. The ashless dispersant of less than 0.01 percent by mass would tend to be insufficient in friction reducing effect. The ashless friction modifier of more than 3 percent by mass would tend to inhibit anti-wear additives from exhibiting their effects or deteriorate the dissolubility thereof.

In order to further enhance the performance characteristics of the low ash engine oil composition of the present invention, it may be blended with any of additives which have been used in lubricating oils, depending on its purposes. Examples of such additives include ashless dispersants, anti-wear agents (extreme pressure additives), friction reducing agents, corrosion inhibitors, rust inhibitors, demulsifiers, metal deactivators, anti-foaming agents, and colorants.

The ashless dispersant may be any ashless dispersant that is used in lubricating oils. Examples of the ashless dispersant include nitrogen-containing compounds having at least one straight-chain or branched alkyl or alkenyl group having 40 to 400 carbon atoms per molecule and derivatives thereof. Examples of such nitrogen-containing compounds include succinimide, benzylamine, polyamines, and Mannich bases. Examples of derivatives of these nitrogen-containing compounds include those produced by allowing a boric compound such as boric acid or borate, a phosphorus compound such as (thio)phosphoric acid or (thio)phosphate, an organic acid, or a hydroxy(poly)oxyalkylene carbonate with these nitrogen-containing compounds. Any one or more of these ashless dispersants may be blended with the engine oil composition of the present invention.

The carbon number of the alkyl or alkenyl group is from 40 to 400, preferably from 60 to 350. The alkyl or alkenyl group of fewer than 40 carbon atoms would cause the poor dissolubility of the compound in the lubricating base oil while the alkyl or alkenyl group of more than 40 carbon atoms would degrade the low-temperature fluidity of the resulting lubricating oil composition. The alkyl or alkenyl group may be straight-chain or branched. Preferred examples include branched alkyl or alkenyl groups derived from an oligomer of an olefin such as propylene, 1-butene, and isobutylene or from a cooligomer of ethylene and propylene.

The ashless dispersant is preferably of a mono and/or bis type, particularly preferably bis type succinimide ashless dispersant, which may or may not contain boron in view of high-temperature detergency.

There is no particular restriction on the content of the ashless dispersant if added. However, the content is usually from 0.01 to 0.4 percent by mass, preferably from 0.05 to 0.2 percent by mass in terms of nitrogen on the basis of the total mass of the lubricating oil composition. In order to further enhance the anti-wear properties and thermal stability of the engine oil composition, it is preferable to add a boron-containing ashless dispersant in a small amount. The content of such a boron-containing ashless dispersant is from 0.001 to 0.2 percent by mass, preferably from 0.005 to 0.1 percent by mass, more preferably from 0.01 to 0.05 percent by mass, more preferably from 0.01 to 0.03 percent by mass in terms of boron.

The anti-wear agent (or extreme pressure additive) which may be used in the present invention may be any anti-wear agent that is used for lubricating oils. For example, sulfuric, phosphoric and sulfuric-phosphoric extreme pressure additives may be used. Specific examples include phosphorus acid esters, thiophosphorus acid esters, dithiophosphorus acid esters, trithiophosphorus acid esters, phosphoric acid esters, thiophosphoric acid esters, dithiophosphoric acid esters, trithiophosphoric acid esters, amine salts, metal salts and derivatives of the foregoing esters, dithiocarbamates, disulfides, polysulfides, sulfurized olefins, and sulfurized fats and oils.

There is no particular restriction on the content of these anti-wear agents (or extreme pressure additives) if added. However, the content is usually from 0.01 to 5 percent by mass on the basis of the total mass of the composition. When the composition of the present invention does not contain Component (B), it is necessarily blended with Component (A) as described above. In this case, in order to provide the engine oil composition of the present invention with anti-wear properties and anti-oxidation properties, it is preferable to use zinc dialkyldithiophosphate having a primary alkyl group and/or a secondary alkyl group, each having 3 to 18 carbon atoms and particularly preferable to use zinc dialkyldithiophosphate having a primary alkyl group and/or a secondary alkyl group, each having 3 to 8 carbon atoms. The content of zinc dialkyldithiophosphate when added is, on the basis of the total mass of the composition, preferably 0.1 percent by mass or less, more preferably 0.09 percent by mass or less in terms of phosphorus because the resulting composition can reduce deposits on the top ring grooves of an diesel engine and is preferably 0.01 percent by mass, more preferably 0.04 percent by mass or more, more preferably 0.06 percent by mass or more because the resulting composition can be provided with both anti-wear properties and anti-oxidation properties. However, when Component (B) is contained, the content of zinc dialkyldithiophosphate is preferably 0.04 percent by mass or less, particularly preferably 0.02 percent by mass or less, most preferably is not contained because the resulting composition can further reduce deposits on the top ring grooves of a diesel engine.

Examples of the friction modifiers include ashless friction modifiers such as fatty acid esters, aliphatic amines and fatty acid amides and metallic friction modifiers such as molybdenum dithiocarbamate and molybdenum dithiophosphate. The content of these friction modifier is usually from 0.15 to 5 percent by mass, on the basis of the total mass of the composition.

Examples of the corrosion inhibitors include benzotriazole-, tolyltriazole-, thiadiazole- and imidazole-type compounds.

Examples of the rust inhibitor include polyhydric alcohol esters, petroleum sulfonates, alkylbenzene sulfonates, dinonylnaphthalene sulfonates, alkenyl succinic acid esters and polyhydric alcohol esters.

Examples of the demulsifiers include polyalkylene glycol-based non-ionic surfactants such as polyoxyethylenealkyl ethers, polyoxyethylenealkylphenyl ethers, and polyoxyethylenealkylnaphthyl ethers.

Examples of the metal deactivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of the anti-foaming agent include silicone oil, alkenylsuccinic acid derivatives, esters of polyhydroxy aliphatic alcohols and long-chain fatty acids, aromatic amine salts of methylsalicylate and o-hydroxybenzyl alcohol, aluminum stearate, potassium oleate, N-dialkyl-allylamine nitroaminoalkanol, and isoamyloctylphosphate, alkylalkylenediphosphates, metal derivatives of thioethers, metal derivatives of disulfides, fluorine compounds of aliphatic hydrocarbons, triethylsilane, dichlorosilane, alkylphenyl polyethylene glycol ether sulfide, and fluoroalkyl ethers.

When the engine oil composition of the present invention contains the above-described additives, the content of each of the corrosion inhibitor, rust inhibitor, and demulsifier is generally from 0.005 to 5 percent by mass, the content of the metal activator is generally from 0.005 to 1 percent by mass, and the content of the anti-foaming agent is generally from 0.0005 to 1 percent by mass, all on the basis of the total mass of the composition.

The sulfated ash content of the low ash engine oil composition of the present invention is 0.6 percent by mass or less, more preferably 0.5 percent by mass or less and preferably 0.1 percent by mass or more, more preferably 0.3 percent by mass or more, particularly preferably 0.4 percent by mass or more so as to further improve detergency in a diesel engine. The "sulfated ash" used herein denotes a value measured by a method described by "Testing Methods for Sulfated Ash" stipulated in JIS K 2272 5.

The sulfur content of the low ash engine oil composition of the present invention is preferably 0.3 percent by mass or less, more preferably 0.2 percent by mass or less, more preferably 0.1 percent by mass or less.

The kinematic viscosity at 100° C. of the engine oil composition of the present invention is preferably from 5.6 to 21.3 $mm^2/s$, more preferably from 9.3 to 16.3 $mm^2/s$, more preferably from 9.3 to 12.5 $mm^2/s$. The "kinematic viscosity at 100° C." denotes a kinematic viscosity at 100° C. stipulated in accordance with ASTM D-445.

The low ash engine oil composition of the present invention is a low ash engine oil composition which is high in viscosity index and low in ash content but still has an engine detergency enabling the composition to pass severe detergency tests for diesel engine oils and is excellent in fuel efficiency. The engine oil composition can exhibit detergency for diesel engines, in particular those equipped with exhaust-gas after-treatment devices such as DPF or various catalysts and exclude adverse affects thereon as much as possible and further can provide an excellent fuel efficiency due to the increased viscosity index and the use of a friction modifier. Further, the low ash engine oil composition of the present invention is preferably used for such diesel engines but also internal combustion engines such as gasoline engines, diesel engines and gas engines for two- and four-wheeled vehicles, power generators, ships and cogenerations. In particular, the engine oil composition is most suitably used for various engines using various fuels, the sulfur content of which is 50 ppm by mass or less, preferably 10 ppm by mass, such as natural gas, LPG, hydrogen, gasoline, kerosene, gas oil, oxygen-containing fuel (bio-diesel fuels such as alcohol, DME and fatty acid esters) and fuels blended with oxygen-containing compounds (gasoline and gas oil). Furthermore, the engine oil composition is also suitably used as a lubricating oil required for fuel and energy saving performances, such as those for power transmitting devices such as manual or automatic transmissions, wet brake oils, hydraulic oils and turbine oils.

APPLICABILITY IN THE INDUSTRY

The low ash engine oil of the present invention can be used as a lubricating oil for internal combustion engines.

EXAMPLES

Hereinafter, the present invention will be described in more details by way of the following examples and comparative examples, which should not be construed as limiting the scope of the invention.

Examples 1 to 6 and Comparative Examples 1 and 2

Engine oil compositions according to the present invention were prepared in accordance with the formulations as set forth in Examples 1 to 6 in Table 1. These compositions were subjected to the following detergency test for diesel engine lubricating oils to evaluate their detergency. For comparison, engine oil compositions were also prepared in accordance with the formulations as set forth in Comparative Examples 1 and 2 and subjected to the same detergency test. The results are set forth in Table 1.

(Detergency Test for Automobile Diesel Engine Oils)

The detergency of each composition was evaluated by measuring the amount of deposits on the top ring grooves (coverage with deposits %: TGF (Top Ring Carbon Filling)) in a detergency test method carried out in accordance with JASO M336-1998. A smaller TGF indicates more excellent detergency. A composition with a TGF of 60 percent or less is regarded as having particularly excellent detergency. The present invention is aiming at providing a composition with a TGF of 50 percent or less, and a composition with a TGF of 30 percent or less is extremely excellent in detergency. It is very difficult to produce a high viscosity index and low ash diesel engine oil with a TGF of 30 percent or less. The diesel fuel used in this test was a sulfur-free gas oil (mineral oil-based) with a sulfur content of less than 10 ppm by mass.

TABLE 1

| | | Example 1 | Example 2 | Example 3 | Example 4 | Example 5 | Comparative Example 1 | Example 6 | Comparative Example 2 |
|---|---|---|---|---|---|---|---|---|---|
| Hydrocracked mineral Oil 1) | mass % | balance | balance | balance | balance | balance | balance | — | — |
| Hydrocracked mineral Oil 2) | mass % | — | — | — | — | — | — | balance | balance |
| Viscosity index improver B 3) | mass % | 5.2 | 5.2 | 5.2 | 5.2 | 5.2 | 5.2 | — | — |
| Viscosity index improver A 4) | mass % | — | — | — | — | — | — | 6.4 | 6.4 |
| (A) Metallic detergent B 5) | mass % | 1 | 1 | 1 | — | 1 | — | 1 | — |
| Metallic detergent A 6) | mass % | 0.56 | 0.56 | 0.56 | 0.75 | 0.56 | 0.75 | 0.56 | 0.75 |
| (B) Sulfur-free phosphorus compound 7) | mass % | 0.65 | 0.55 | — | 0.65 | 0.65 | — | — | — |
| ZDTP 8) | mass % | — | 0.175 | 1.2 | — | — | 1.2 | 1.2 | 1.2 |
| Ashless anti-oxidant 9) | mass % | 1 | 1 | 1 | 1 | 1 | 1 | 1 | 1 |
| Organic Mo Compound 10) | mass % | 0.15 | 0.15 | 0.15 | 0.15 | 0.15 | 0.15 | 0.15 | 0.15 |
| Ashless friction modifier 11) | mass % | — | — | — | — | 0.3 | — | — | — |
| Ashless dispersant 12) | mass % | 6 | 6 | 6 | 6 | 6 | 6 | 6 | 6 |
| Viscosity index of composition | | 210 | 210 | 210 | 210 | 210 | 210 | 170 | 170 |
| Sulfated ash content of composition | mass % | 0.55 | 0.55 | 0.55 | 0.55 | 0.55 | 0.55 | 0.55 | 0.55 |
| Elementary analysis of composition B | mass % | 0.01 | 0.01 | 0.01 | 0.01 | 0.01 | 0.01 | 0.01 | 0.01 |
| Ca | mass % | 0.095 | 0.095 | 0.095 | 0.095 | 0.095 | 0.095 | 0.095 | 0.095 |
| Mo | mass % | 0.015 | 0.015 | 0.015 | 0.015 | 0.015 | 0.015 | 0.015 | 0.015 |
| P | mass % | 0.086 | 0.086 | 0.086 | 0.086 | 0.086 | 0.086 | 0.086 | 0.086 |
| S | mass % | 0.07 | 0.09 | 0.25 | 0.04 | 0.07 | 0.26 | 0.26 | 0.23 |
| Zn | mass % | 0.086 | 0.087 | 0.094 | 0.094 | 0.086 | 0.094 | 0.094 | 0.094 |
| N (Trace nitrogen chemiluminescence method) | mass % | 0.11 | 0.11 | 0.11 | 0.11 | 0.14 | 0.11 | 0.11 | 0.11 |
| Detergency test result | TGF(%) | 12.4 | 25.4 | 50 | 20.6 | 16.4 | 62.5 | 48.3 | 58.3 |

1) % CA: 0, Sulfur: 10 mass ppm, viscosity index: 120, kinematic viscosity at 40° C.: 19.5 $mm^2/S$ 2) % CA: 0, Sulfur: 10 mass ppm, viscosity index: 121, kinematic viscosity at 40° C.: 22.5 $mm^2/S$ 3) Dispersant-type polymethacrylate viscosity index improver, weight-average molecular weight: 400,000, PSSI: 45

4) Olefin copolymer viscosity index improver, weight-average molecular weight: 90,000, PSSI: 25

5) Neutral Ca sulfonate TBN (ASTM: D-2895): 17 mg KOH/g, Ca: 2.35 mass %, S: 2.9 mass %, metal ratio: about 1

6) Overbased Ca sulfonate TBN (ASTM: D-2895): 325 mg KOH/g, Ca: 12.7 mass %, S: 2 mass %, metal ratio: about 10

7) Zinc di-n-butylphosphate, P: 13.2 mass %, S: 0 mass %, Zn: 13.0 mass %

8) Alkyl group: sec. butyl/sec. hexyl, P: 7.2 mass %, S: 15.2 mass %, Zn: 7.8 mass %

9) Phenolic and aminic anti-oxidant (1:1)

10) Oxymolybdenum ditridecylamine complex Mo: 10 mass %, S: 0 mass %

11) Monooleyl urea: R—NH—C(═O)—$NH_2$, R: oleyl group, N: 8.9 mass %

12) Polybutenyl succinimide (number average molecular weight of polybutenyl group: 1300) and boric acid-modified polybutenyl succinimide (number average molecular weight of polybutenyl group: 1300)

The invention claimed is:

1. A low ash engine oil composition with a sulfated ash content of 0.6 percent by mass or less, consisting essentially of:

a lubricating base oil with a % $C_A$ of 2 or less, a kinematic viscosity at 40° C. of 25 $mm^2/s$ or less and a viscosity index of 120 or greater;

a viscosity index improver contained in such an amount that the viscosity index of the composition will be 160 or greater;

a metallic detergent with a metal ratio of 3 or less selected from an alkaline earth metal sulfonate and an alkaline earth metal phenate;

a metallic detergent with a metal ratio of greater than 3 selected from an alkaline earth metal sulfonate and an alkaline earth metal phenate;

a sulfur-free phosphorus compound; and at least one additive selected from the group consisting of an ashless antioxidant, a friction modifier, an ashless dispersant, an antiwear agent, an extreme pressure additive, a corrosion inhibitor, a rust inhibitor, a demulsifier, a metal deactivator, an antifoaming agent, and a colorant.

2. The low ash engine oil composition according to claim 1, wherein the viscosity index improver is a polymethacrylate with a PSSI of 10 or greater, and the composition has a viscosity index of 190 or greater.

3. The low ash engine oil composition according to claim 1, wherein the friction modifier comprises an organic molybdenum compound.

* * * * *